US005871213A

United States Patent [19]

Chadband et al.

[11] Patent Number: 5,871,213

[45] Date of Patent: Feb. 16, 1999

[54] METHOD OF BET PLACEMENT AND WAGER DISTRIBUTION

[75] Inventors: Paul G. Chadband; Hai Q. Huynh, both of San Jose, Calif.

[73] Assignee: Sutter's Place, San Jose, Calif.

[21] Appl. No.: 845,962

[22] Filed: Apr. 30, 1997

[51] Int. Cl.[6] ..... A63F 1/00

[52] U.S. Cl. ..... 273/292; 273/274; 273/309

[58] Field of Search ..... 273/292, 274, 273/309; 463/12, 13

[56] References Cited

U.S. PATENT DOCUMENTS

| | | | |
|---|---|---|---|
| 5,314,194 | 5/1994 | Wolf | 273/292 |
| 5,397,128 | 3/1995 | Hesse et al. | 273/292 |
| 5,452,899 | 9/1995 | Skratulia | 273/292 |
| 5,452,900 | 9/1995 | Skratulia | 273/292 |
| 5,494,295 | 2/1996 | Potter et al. | 273/292 |
| 5,607,161 | 3/1997 | Skratulia | 273/292 |

*Primary Examiner*—Benjamin H. Layno

*Attorney, Agent, or Firm*—Finley & Berg, LLP

[57] ABSTRACT

A method of bet placement and wager distribution for use with gambling games conducted in rounds; each round frontline players place wagers on their own final ranking in the associated game into a frontline players' pot, and backline players place wagers on the relative final rankings of the frontline players into a backline players' pot. The game round is fully played out, and then the relative rankings of the frontline players are determined, identifying a highest ranked frontline player or players and a second highest ranked frontline player or players. The relative rankings of the backline players are then determined by reference to the rankings of the frontline players they selected, identifying a highest ranked backline player or players and a second-highest ranked backline player or players. The frontline players' pot is then apportioned between the highest-ranked and second-highest ranked frontline players according to a predetermined formula, and the backline players' pot is apportioned between the highest-ranked and second-highest ranked backline players according to a predetermined formula.

27 Claims, 8 Drawing Sheets

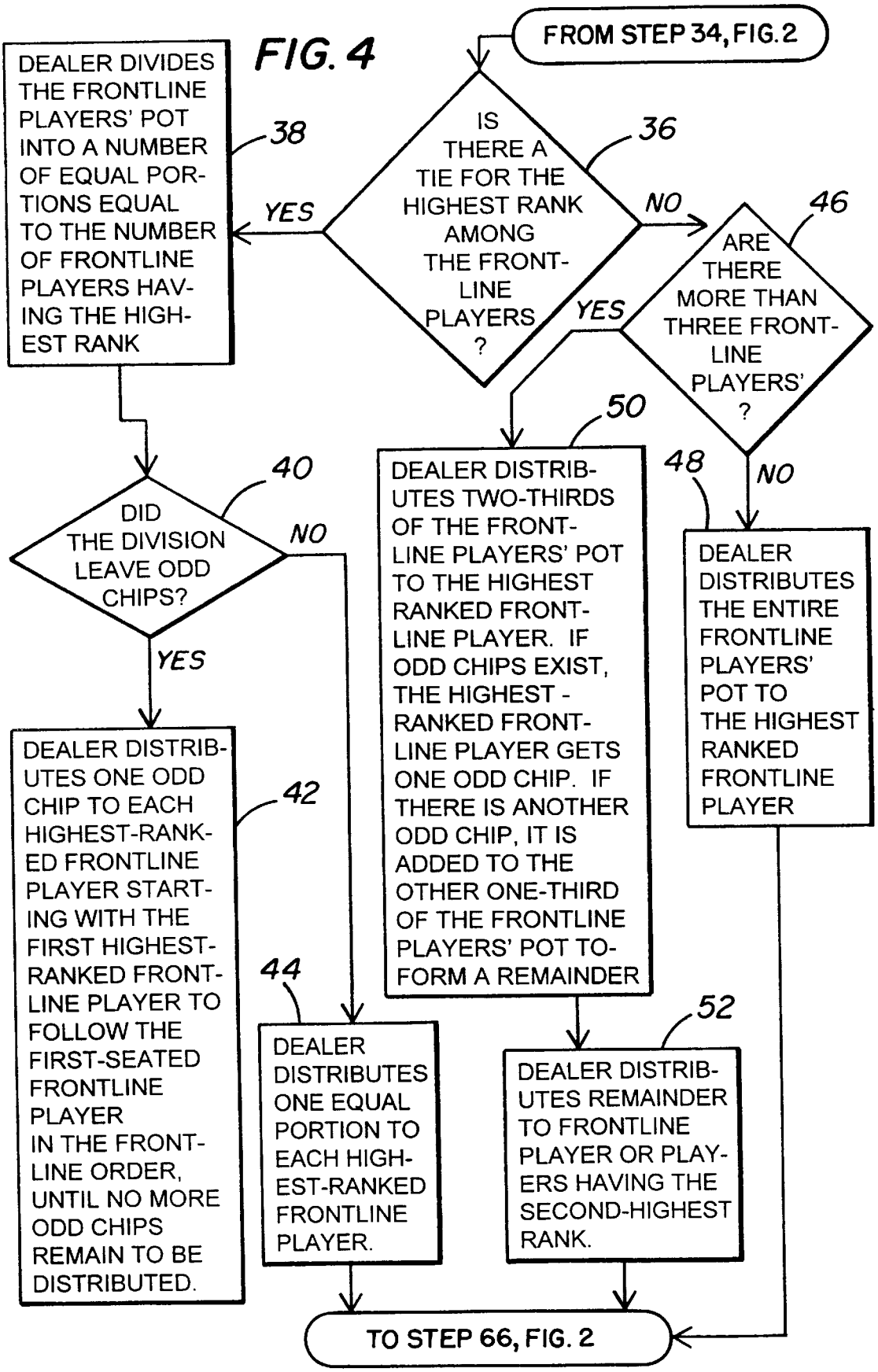
FIG. 4
FROM STEP 34, FIG. 2
IS THERE A TIE FOR THE HIGHEST RANK AMONG THE FRONT-LINE PLAYERS ?
36
YES
NO
DEALER DIVIDES THE FRONTLINE PLAYERS' POT INTO A NUMBER OF EQUAL PORTIONS EQUAL TO THE NUMBER OF FRONTLINE PLAYERS HAVING THE HIGHEST RANK
38
ARE THERE MORE THAN THREE FRONT-LINE PLAYERS' ?
46
YES
NO
DID THE DIVISION LEAVE ODD CHIPS?
40
NO
YES
DEALER DISTRIBUTES TWO-THIRDS OF THE FRONT-LINE PLAYERS' POT TO THE HIGHEST RANKED FRONT-LINE PLAYER. IF ODD CHIPS EXIST, THE HIGHEST - RANKED FRONT-LINE PLAYER GETS ONE ODD CHIP. IF THERE IS ANOTHER ODD CHIP, IT IS ADDED TO THE OTHER ONE-THIRD OF THE FRONTLINE PLAYERS' POT TO-FORM A REMAINDER
50
48
DEALER DISTRIBUTES THE ENTIRE FRONTLINE PLAYERS' POT TO THE HIGHEST RANKED FRONTLINE PLAYER
DEALER DISTRIBUTES ONE ODD CHIP TO EACH HIGHEST-RANKED FRONTLINE PLAYER STARTING WITH THE FIRST HIGHEST-RANKED FRONT-LINE PLAYER TO FOLLOW THE FIRST-SEATED FRONTLINE PLAYER IN THE FRONT-LINE ORDER, UNTIL NO MORE ODD CHIPS REMAIN TO BE DISTRIBUTED.
42
44
DEALER DISTRIBUTES ONE EQUAL PORTION TO EACH HIGHEST-RANKED FRONTLINE PLAYER.
52
DEALER DISTRIBUTES REMAINDER TO FRONTLINE PLAYER OR PLAYERS HAVING THE SECOND-HIGHEST RANK.
TO STEP 66, FIG. 2

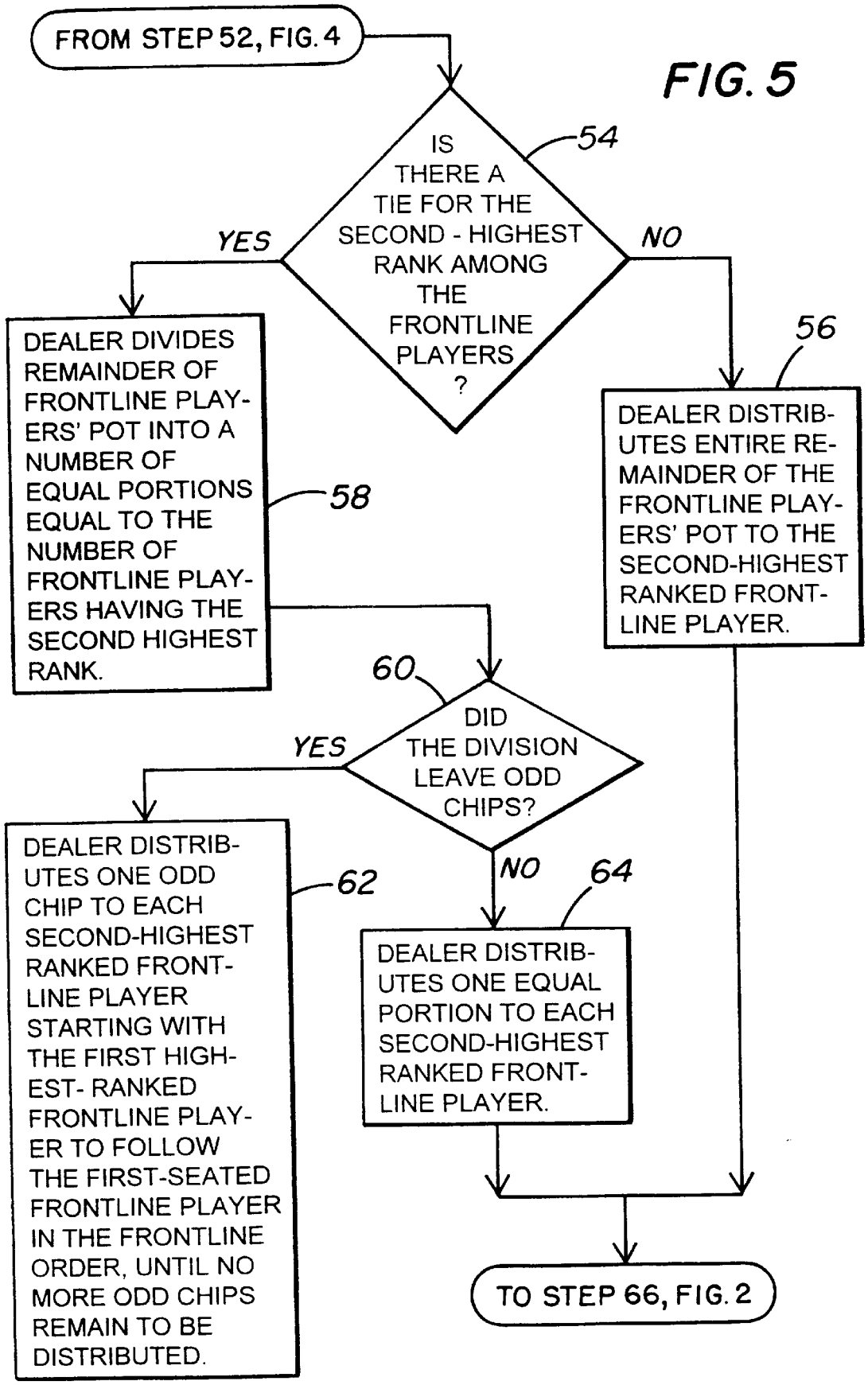
FROM STEP 52, FIG. 4
FIG. 5
IS THERE A TIE FOR THE SECOND - HIGHEST RANK AMONG THE FRONTLINE PLAYERS ?
54
YES
NO
DEALER DIVIDES REMAINDER OF FRONTLINE PLAYERS' POT INTO A NUMBER OF EQUAL PORTIONS EQUAL TO THE NUMBER OF FRONTLINE PLAYERS HAVING THE SECOND HIGHEST RANK.
58
56
DEALER DISTRIBUTES ENTIRE REMAINDER OF THE FRONTLINE PLAYERS' POT TO THE SECOND-HIGHEST RANKED FRONTLINE PLAYER.
60
DID THE DIVISION LEAVE ODD CHIPS?
YES
NO
DEALER DISTRIBUTES ONE ODD CHIP TO EACH SECOND-HIGHEST RANKED FRONTLINE PLAYER STARTING WITH THE FIRST HIGHEST- RANKED FRONTLINE PLAYER TO FOLLOW THE FIRST-SEATED FRONTLINE PLAYER IN THE FRONTLINE ORDER, UNTIL NO MORE ODD CHIPS REMAIN TO BE DISTRIBUTED.
62
64
DEALER DISTRIBUTES ONE EQUAL PORTION TO EACH SECOND-HIGHEST RANKED FRONTLINE PLAYER.
TO STEP 66, FIG. 2

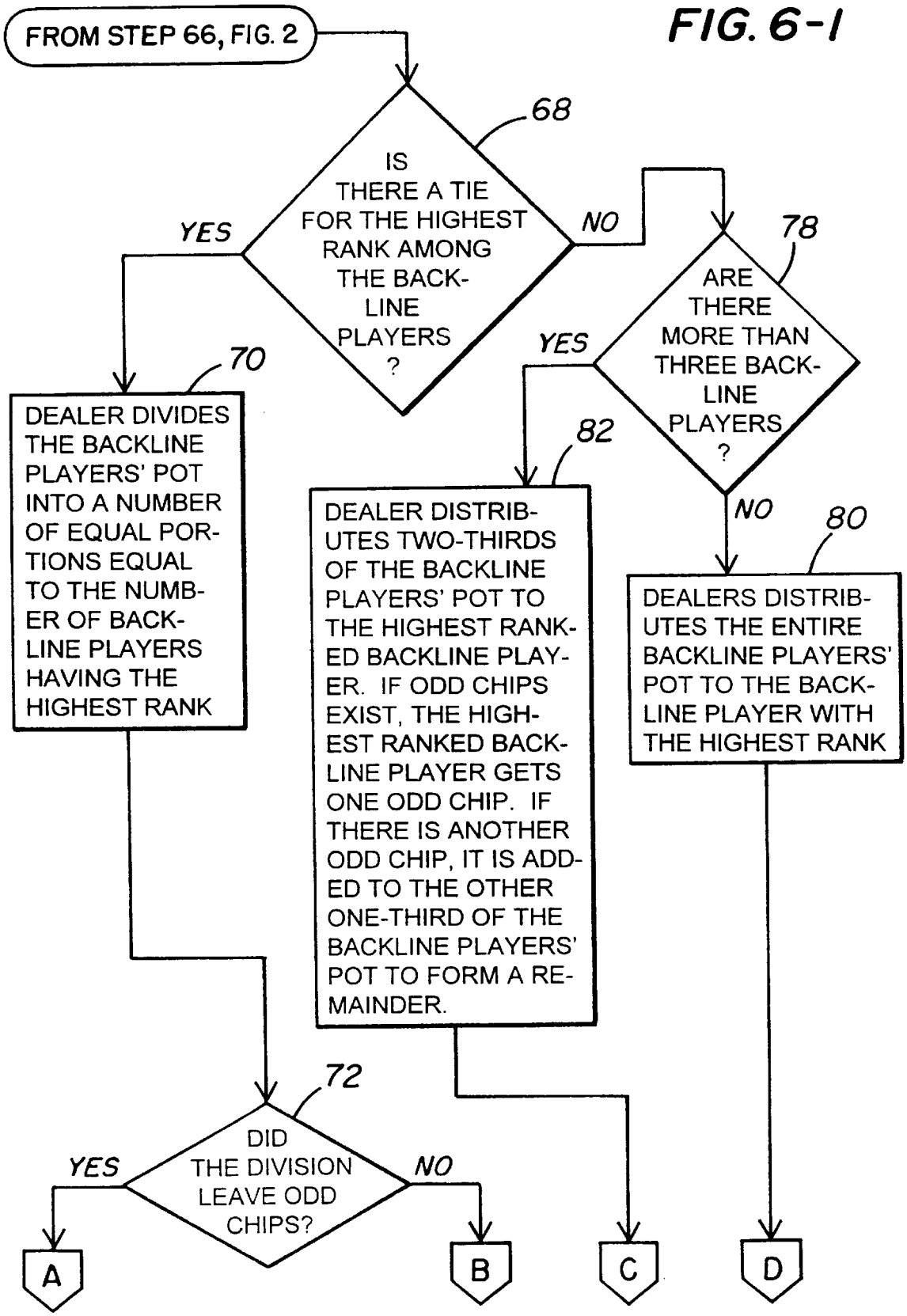
FROM STEP 66, FIG. 2
FIG. 6-1
68
IS THERE A TIE FOR THE HIGHEST RANK AMONG THE BACK-LINE PLAYERS ?
YES
NO
78
ARE THERE MORE THAN THREE BACK-LINE PLAYERS ?
YES
NO
70
DEALER DIVIDES THE BACKLINE PLAYERS' POT INTO A NUMBER OF EQUAL PORTIONS EQUAL TO THE NUMBER OF BACK-LINE PLAYERS HAVING THE HIGHEST RANK
82
DEALER DISTRIBUTES TWO-THIRDS OF THE BACKLINE PLAYERS' POT TO THE HIGHEST RANKED BACKLINE PLAYER. IF ODD CHIPS EXIST, THE HIGHEST RANKED BACK-LINE PLAYER GETS ONE ODD CHIP. IF THERE IS ANOTHER ODD CHIP, IT IS ADDED TO THE OTHER ONE-THIRD OF THE BACKLINE PLAYERS' POT TO FORM A REMAINDER.
80
DEALERS DISTRIBUTES THE ENTIRE BACKLINE PLAYERS' POT TO THE BACK-LINE PLAYER WITH THE HIGHEST RANK
72
DID THE DIVISION LEAVE ODD CHIPS?
YES
NO
A
B
C
D

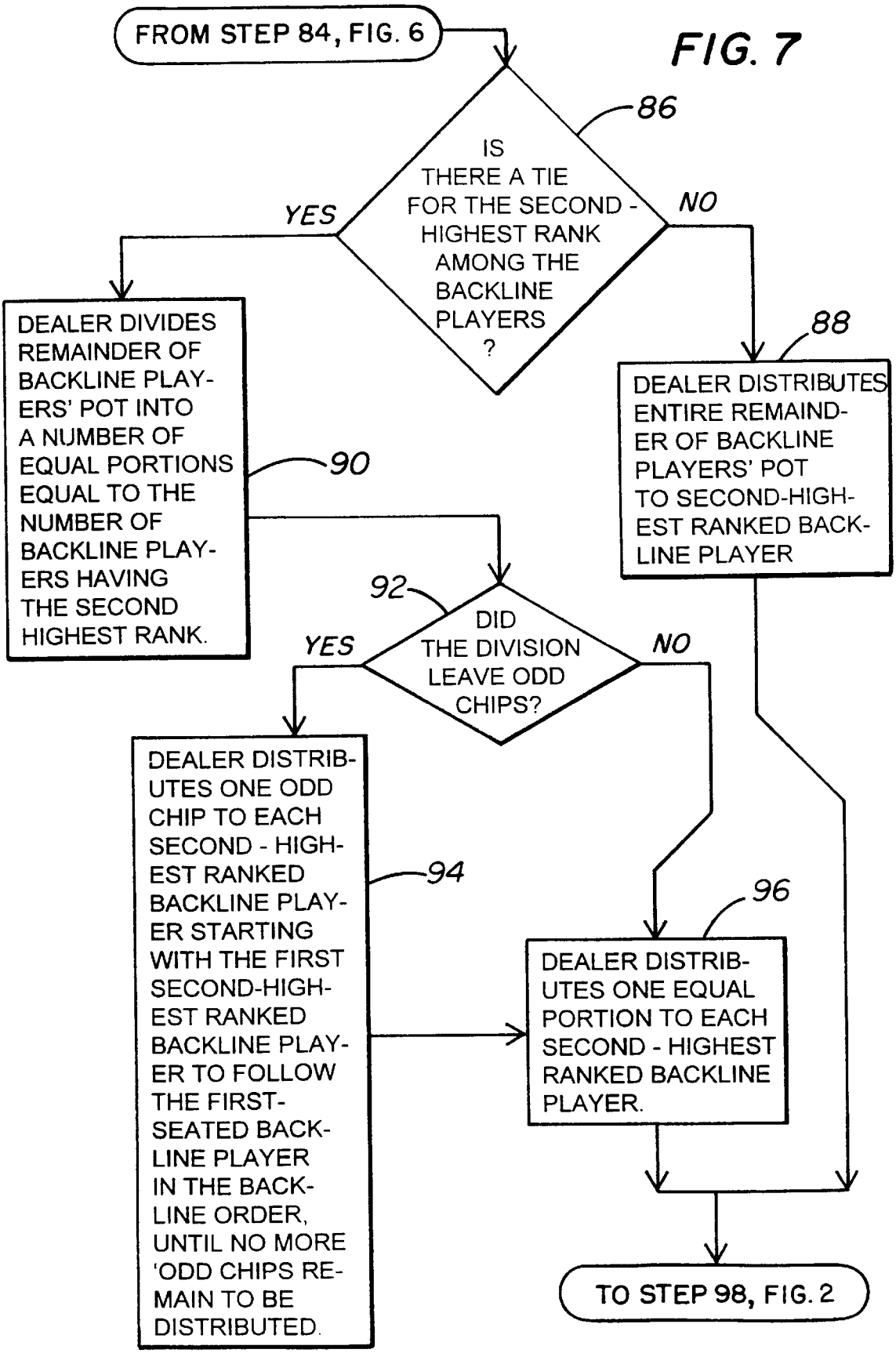
FROM STEP 84, FIG. 6
FIG. 7
86
IS THERE A TIE FOR THE SECOND - HIGHEST RANK AMONG THE BACKLINE PLAYERS ?
YES
NO
DEALER DIVIDES REMAINDER OF BACKLINE PLAYERS' POT INTO A NUMBER OF EQUAL PORTIONS EQUAL TO THE NUMBER OF BACKLINE PLAYERS HAVING THE SECOND HIGHEST RANK.
90
88
DEALER DISTRIBUTES ENTIRE REMAINDER OF BACKLINE PLAYERS' POT TO SECOND-HIGHEST RANKED BACKLINE PLAYER
92
DID THE DIVISION LEAVE ODD CHIPS?
YES
NO
DEALER DISTRIBUTES ONE ODD CHIP TO EACH SECOND - HIGHEST RANKED BACKLINE PLAYER STARTING WITH THE FIRST SECOND-HIGHEST RANKED BACKLINE PLAYER TO FOLLOW THE FIRST-SEATED BACKLINE PLAYER IN THE BACKLINE ORDER, UNTIL NO MORE 'ODD CHIPS REMAIN TO BE DISTRIBUTED.
94
96
DEALER DISTRIBUTES ONE EQUAL PORTION TO EACH SECOND - HIGHEST RANKED BACKLINE PLAYER.
TO STEP 98, FIG. 2

METHOD OF BET PLACEMENT AND WAGER DISTRIBUTION

FIELD OF THE INVENTION

This invention relates to methods of bet placement and distributions of wagers for multi-player gambling games.

BACKGROUND OF THE INVENTION

The primary difference between a standard game and a gambling game is the wager, and wagering methods largely define the appeal of a gambling game. Many of the most common casino games have been popular for centuries, and for the most part, the wagering methods used to gamble on the results of the games are equally as hallowed. By offering a new method of wagering, the excitement of existing games may be enhanced, and players will be further attracted to play.

Traditional gambling, especially as seen in casinos, is conducted in two main modes. The first, most common mode involves players betting against the house. This includes games such as blackjack or roulette. The rules and setup of these games are designed such that the odds favor the house over the players, and from this odds discrepancy the house makes its profit. Such games deny the player the opportunity to test the player's luck in an even odds situation.

Additionally, the wager distribution in these games does not allow the player to win more than the amount the player bet on a given bet except where the odds are prohibitive against the player winning. In blackjack, where players have close to equal odds of winning, players only have the opportunity to win as much as the amount of their bet, except on rare blackjack hands. In other games, such as roulette, it is possible for the player to win many times the amount of the bet, but only if the player defeats odds such as thirty-eight to one. None of these games allow players having equal odds of winning to win more than the amount of their bet.

The second, less common casino gambling mode involves players competing against each other. An example of such a game is poker. However, unlike games against the house, which allow multiple players to win, these games are usually formulated such that the winner takes all. This offers less excitement than a game in which multiple players win on each bet.

Additionally, in games where players compete directly against each other, usually one player must serve as a banker or a player/banker. Where a player is solely the banker, that player cannot enjoy playing the game on that round. Where a player serves as a player/banker, disputes over money handling are more likely to occur as the banker has a direct stake in who wins or loses. Use of a banker or player/banker also complicates the game, as some means becomes necessary to identify which player serves the role each round.

Finally, few games in either mode provide the opportunity for a second level of wagering in which second line wagerers may wager between themselves on the relative success of the active players. No background art has been found which uses such second level wagering in combination with a method of wager distribution which allows multiple second line wagerers to win on each bet.

None of the foregoing games use wager distribution methods in which multiple players win each round, all players may play every round, all players compete against each other at even odds while still having the opportunity to win an amount greater than which they bet, and second line wagering is permitted.

SUMMARY OF THE INVENTION

The present invention, "No Dice Pot," is a novel bet placement and wager distribution method for use in conjunction with a gambling game. This method may be applied to many popular existing casino games, including card games such as Pan Nine, Pai Gow Poker, or California blackjack, or tile games such as Pai Gow or Dominoes. The game is conducted in rounds of play, with a plurality of players, and each player controls a hand which can be ranked in comparison to the other players' hands.

At the beginning of each round of play of the associated game, "frontline" players place wagers on their own final ranking into a frontline players' pot. Backline players each choose at least one frontline player on whose relative final ranking the backline player chooses to bet and place their wagers into a backline players' pot. The game round is fully played out, and then the relative rankings of the frontline players are determined, identifying a highest ranked frontline player or players and a second highest ranked frontline player or players. The relative rankings of the backline players are then determined by reference to the rankings of the frontline players they selected, identifying a highest ranked backline player or players and a second-highest ranked backline player or players. The frontline players' pot is then apportioned between the highest-ranked and second-highest ranked frontline players according to a predetermined formula, and the backline players' pot is apportioned between the highest-ranked and second-highest ranked backline players according to a predetermined formula.

A primary object of the present invention is to avoid the "winner takes all" betting scheme by splitting the frontline and backline players' pots between the highest and second highest ranked players.

A further object of the present invention is to allow the game players to compete directly against each other rather than each against the house.

Another object of the present invention is to allow the game players to make wagers where they have even odds of winning against the other players.

A still further object of the present invention is to allow play of a wagering game without the need for a banker, player/banker, or the use of dice.

Yet another object of the invention is to allow players to make second-line, or "backline," wagers.

A further object of the present invention is to allow players to make fixed-limit wagers while allowing the player to win more than the wagered amount.

Other objects and advantages of the present invention will become apparent when the method for bet placement and wager distribution of the present invention is considered in conjunction with the accompanying drawings, specification, and claims.

BRIEF DESCRIPTION OF THE DRAWINGS

FIG. 4 is a flow diagram showing the sequence of steps of distributing frontline wagers among frontline players receiving the primary share of the winnings.

FIG. 5 is a flow diagram showing the sequence of steps of distributing frontline wagers among frontline players receiving a secondary share of the winnings.

FIGS. 6-1 and 6-2 together constitute a flow diagram showing the sequence of steps of distributing backline wagers among backline players receiving the primary share of the winnings.

FIG. 7 is a flow diagram showing the sequence of steps of distributing backline wagers among backline players receiving the secondary share of the winnings.

DESCRIPTION OF THE PREFERRED EMBODIMENT

Figure 1:
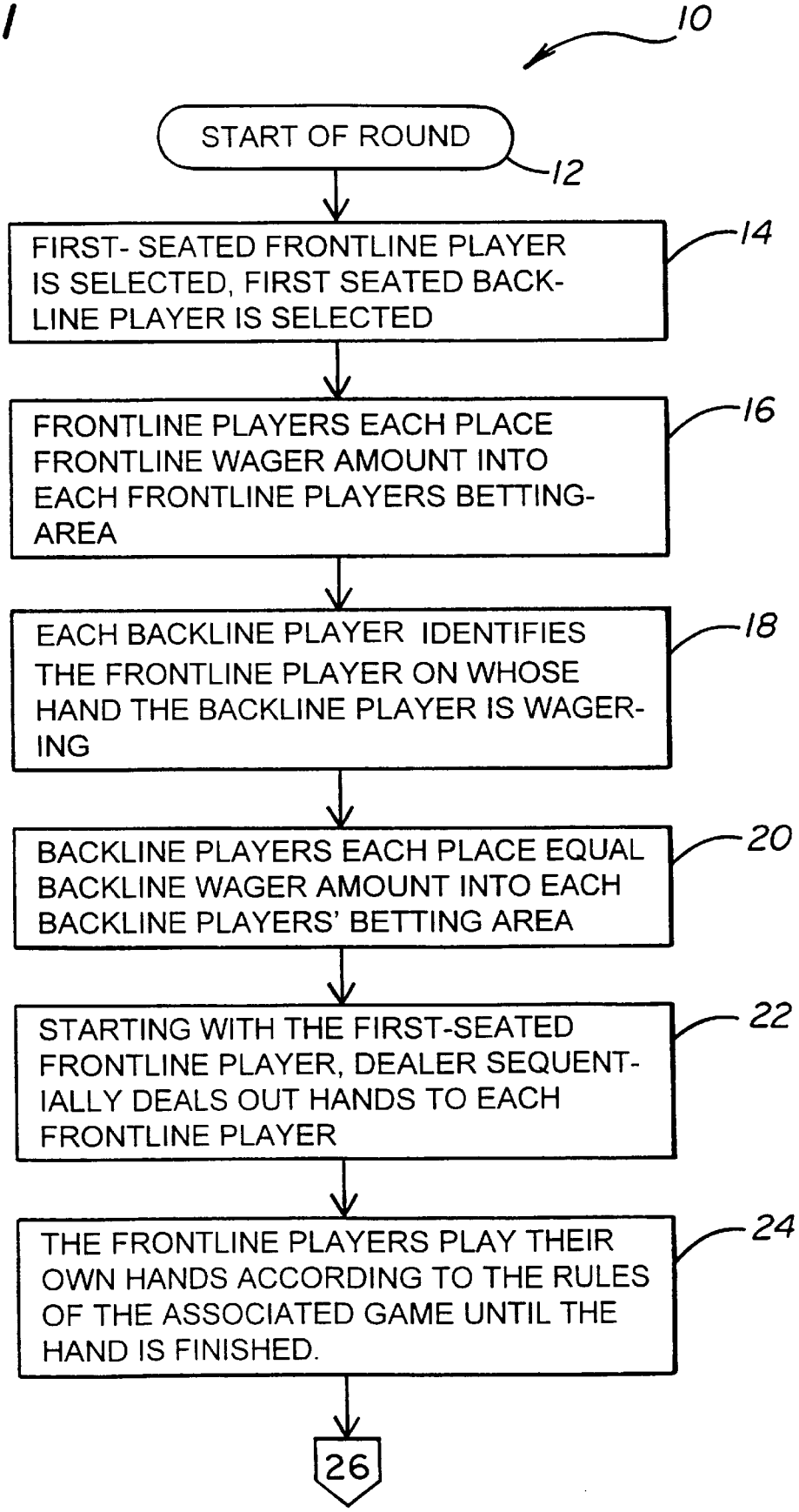
FIG. 1 is a flow diagram showing the initial sequence of steps comprising the inventive method No Dice Pot.
Figure 2:
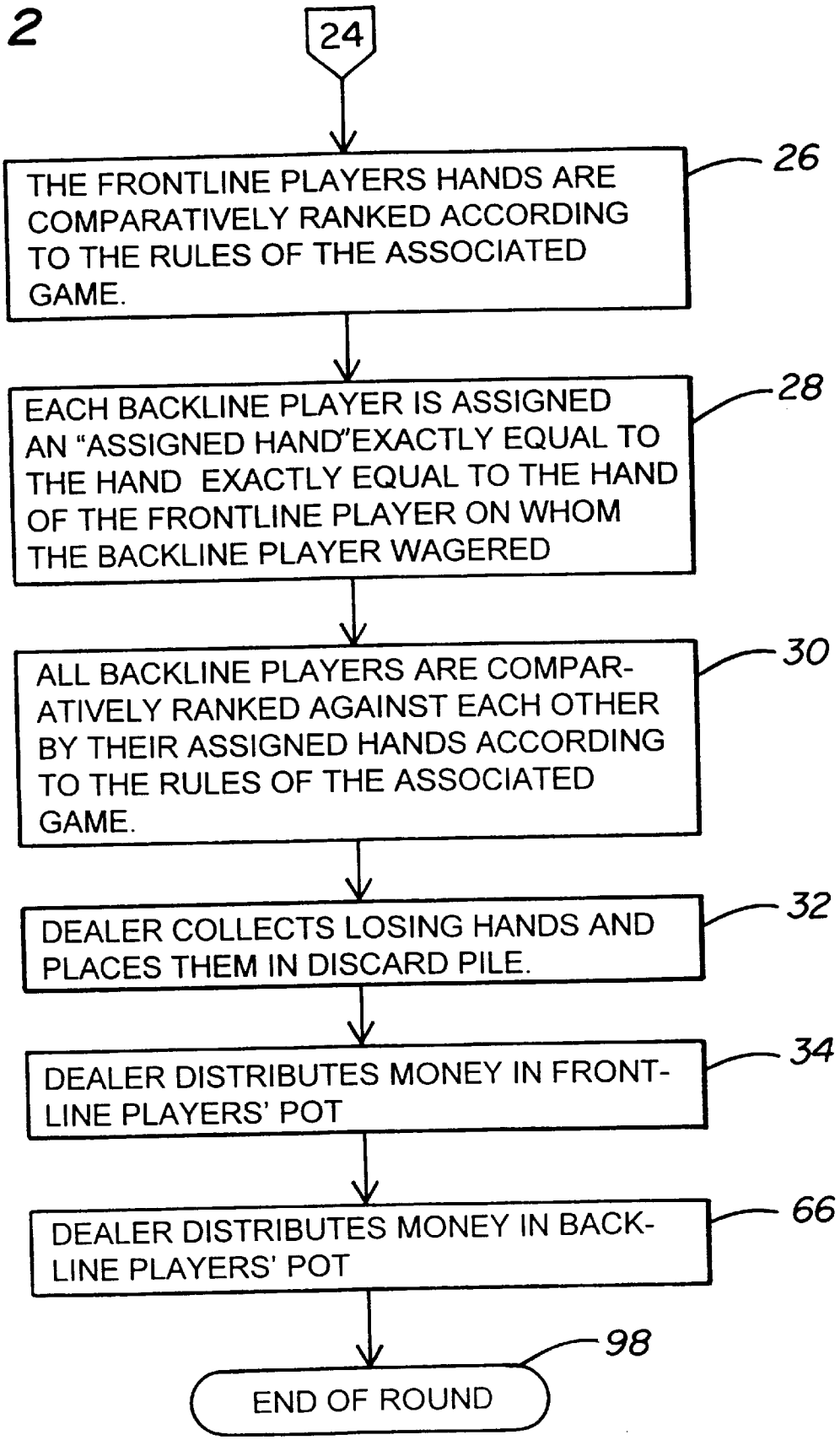
FIG. 2 is a flow diagram continuing the sequence of steps comprising the inventive method No Dice Pot from FIG. 1.

FIGS. 1 and 2 portray a flow diagram of the order of steps used in the No Dice Pot method 10. For purposes of discussion, it shall be assumed that the No Dice Pot method 10 is used in conjunction with a card game such as Pan Nine, Pai Gow Poker, or California Blackjack, although it should be understood that the method may be used with any legal game played in rounds in which each active player controls a discrete "hand" which, at the end of play, may be ranked in comparison with other players' "hands". It should be noted that, while the term "hand" is used throughout this application to be consistent with the card game example, a "hand" for purposes of this application can be any holding of a player in a game, including but not limited to a collection of tiles, a dice roll, or a choice of a racer at a race.

Figure 3:
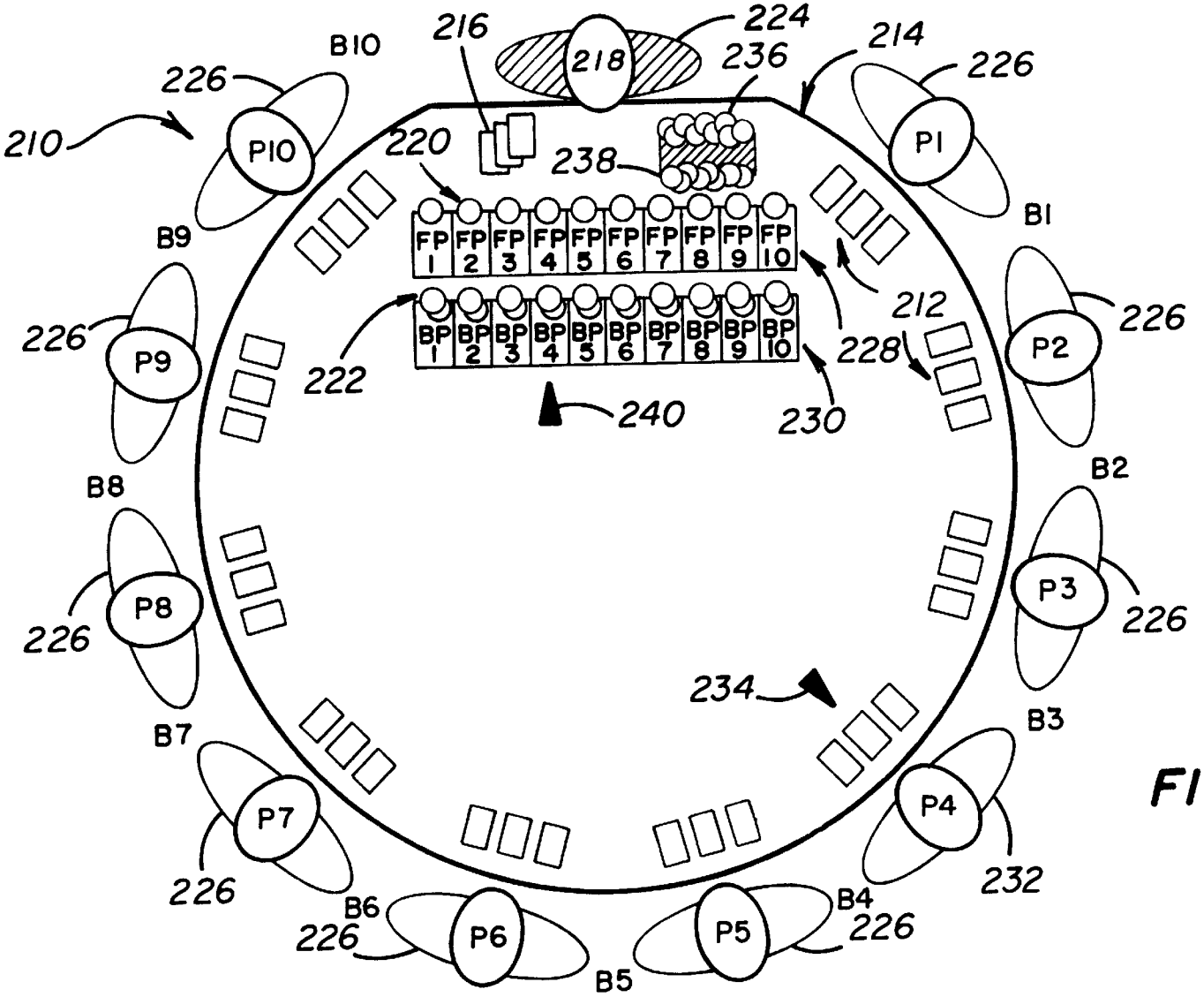
FIG. 3 is a plan view of the operation of No Dice Pot in conjunction with a card game on a playing table designed for use with the No Dice Pot method.
Figures 2, 6:
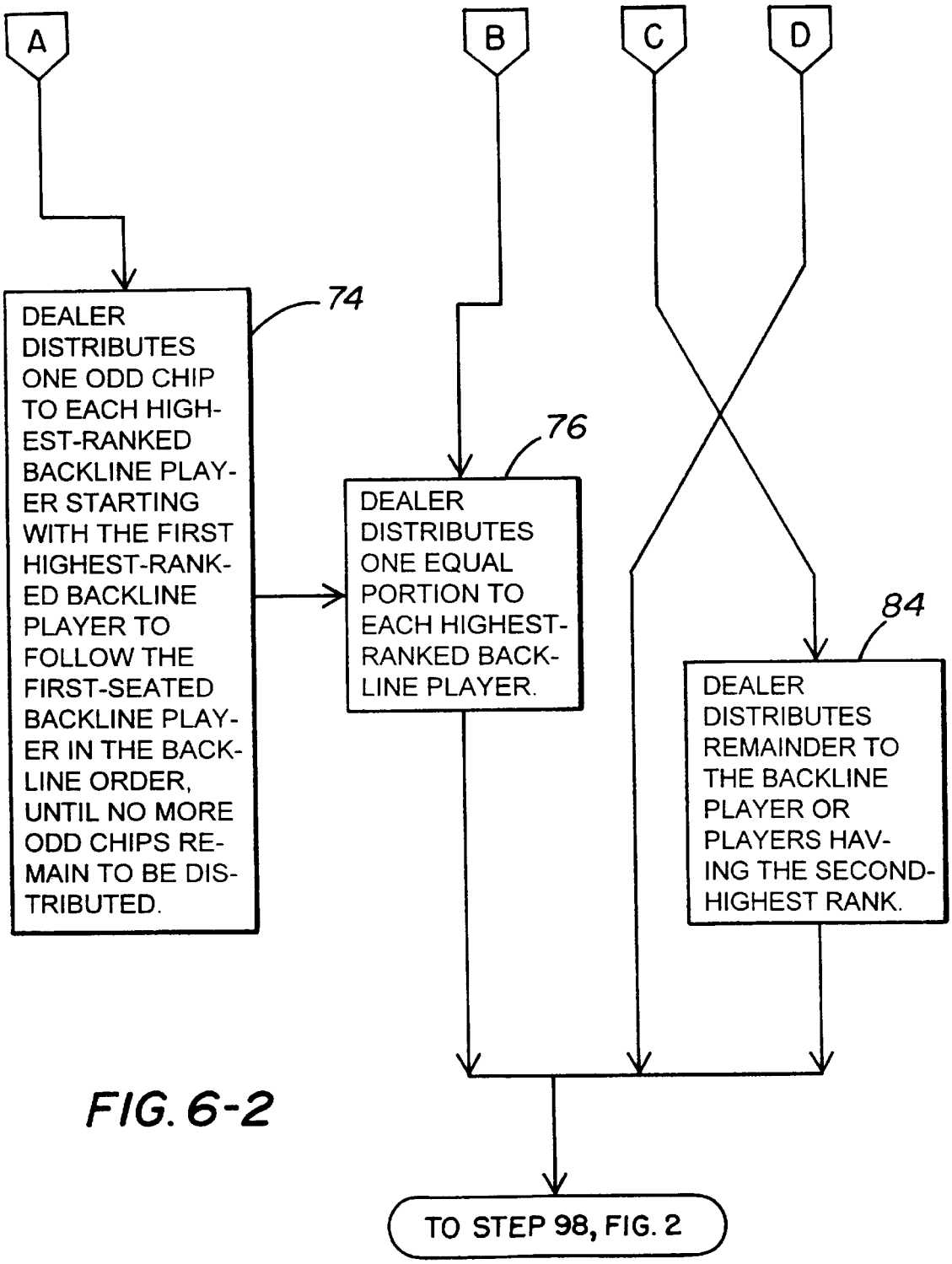

FIG. 3 shows generally the operation of No Dice Pot with a card game 210. The players' hands are designated 212. In the preferred embodiment, the associated game is played at a table 214. Equipment used in play of the associated game is employed as needed. This could include, but is not limited to: a standard deck of fifty-two cards 216, several such standard decks, a special deck such as the deck used in California blackjack which has four additional special aces, several such special decks, or a collection of tiles as for Pai Gow or Dominoes.

In the preferred embodiment, a dealer 218 is chosen to control the deck of cards 216, identify winning hands, and collect all wagers 220 and 222. The dealer 218 is preferably a non-wagering, disinterested party. However, the invention encompasses play in which the role of dealer 218 is filled by a player.

In a preferred embodiment, two types of players may place wagers each round: "frontline" players P1–P10 and "backline" players B1–B10. Frontline players P1–P10 are active in the game, receiving and controlling hands 212. Backline players B1–B10 wager on the relative final ranking of the hands of frontline players P1–P10 against the other backline players. Note that the inclusion of backline players is preferred but is not necessary to the present invention.

When backline play is allowed, backline players B1–B10 have the right to collaborate with frontline players P1–P10 in controlling play of hands 212. However, frontline players P1–P10 have the right to make the final decisions on play of hands 212. It should be understood that the method of the present invention allows house rules to determine whether each frontline player has the right to refuse to allow another player to select the frontline player's hand for backline play.

The number of frontline players P1–P10 may be limited by the number of decks used in a card game, or by the rules of the game; limits on the number of backline players B1–B10 and further limits on the number of frontline players P1–P10 are posed only by factors of convenience. For clarity, the embodiment described here establishes a limit of ten frontline players P1–P10 and ten backline players B1–B10, but it is to be understood that the No Dice Pot method may be used with any number of frontline players exceeding one.

It is to be understood that a single person may serve as multiple frontline players, as multiple backline players, or both as frontline and backline players, as long as that person wagers separate amounts for each player position. For purposes of this application, such single persons shall be treated as if each player position controlled by that single person were a distinct frontline or backline player.

In the preferred embodiment, table 214 identifies a dealer's seat 224 and a number of players' seat positions 226 equal to the maximum number of frontline players P1–P10, here ten. Table 214 also provides two separate wagering areas: a frontline players' pot 228, and a backline players' pot 230. Preferably, the frontline players' pot comprises separate betting areas FP1–FP10 for the frontline wagers 220 of each frontline player, and the backline players' pot comprises separate betting areas BP1–BP10 for the backline wagers 222 of each backline player.

In an alternative configuration (not shown), betting areas FP1–FP10 and BP1–BP10 are distinct from frontline players' pot 228 and backline players' pot 230. Instead, matching pairs of frontline and backline betting areas are positioned on table 214 in front of each of players' seat positions 226. For example, betting areas FP1 and BP1 would be positioned near the edge of table 214 at closest proximity to the players' seat closest to the dealer's seat 224 on the left, and betting areas FP10 and BP10 would be positioned near the edge of table 214 at closest proximity to the players' seat closest to the dealer's seat 224 on the right. It is to be understood that other placements of the frontline and backline betting areas are also possible.

Referring to FIGS. 1 and 3, the No Dice Pot method begins with step 12, the start of a round of play of the game. At that time, the dealer 214 identifies which frontline players P1–P10 and backline players B1–B10 wish to participate in that round of play. In a preferred embodiment, step 12 includes giving a unique identifying position to each frontline player P1–P10 such as seat positions 226 having corresponding identifying numbers FP1–FP10. Where each frontline player is a distinct person, each frontline player sits in the seat having that player's identifying number.

Note that if any one person is playing as multiple frontline players as described above, that person cannot sit at each seat position controlled by that player. Preferably, in that situation, that person sits at one of the seat positions corresponding to that person's frontline player positions and represents to dealer 218 that that person is playing the other frontline player positions. Dealer 218 then ensures that no other person sits at the seat positions corresponding to the other frontline player positions.

In step 14, the play order of frontline players P1–P10 is determined by choosing a first-seated player 232 and having the play order rotate from the first-seated player 232. Preferably, the frontline players P1–P10 are seated in a roughly circular fashion, and the play sequence proceeds clockwise from the first-seated player 232. However, it should be understood that the play sequence could also proceed counterclockwise or according to some other preset ordering scheme. Preferably, the position of first-seated player 232 moves one step along the rotation between rounds of the game so that each player has the opportunity to play from every player position. In a preferred embodiment, step 14 includes placing a marker 234, which could include a button or a disc, in front of the first-seated player 232 to identify the current first-seated player 232.

In step 16, each frontline player P1–P10 wagers a frontline amount and places that wager 220 into the betting area of the frontline players' pot 228 corresponding to that player's identifying number FP1–FP10. Preferably each frontline wager is of an equal amount.

In step 18, backline players B1–B10 each identify which frontline player on whose hand that backline player wishes to bet. In step 20, each backline player B1–B10 then wagers a backline amount by placing that wager into the backline players' betting area corresponding to the frontline player on whose hand the backline player wagered. Preferably each backline wager is of an equal amount. In a preferred embodiment, each backline player may identify which wager that backline player placed by standing behind the seat position of the frontline player on whom the backline player wagered.

Note that if any one person is playing as multiple backline players or as both a frontline and a backline player, as described above, that person cannot stand behind each frontline player on whom the backline player bet. Preferably, in that situation, that person represents to dealer 218 that that person is playing each of the backline player positions. Dealer 218 then keeps track of which person is in control of each backline wager.

Both the frontline and backline wager amounts may be determined separately by the frontline and backline players respectively each round. However, to forestall conflicts between players, in a preferred embodiment, table limits set specific frontline and backline wager amounts. For example, table 214 could set the frontline wager amount to twenty-four dollars and the backline amount to twelve dollars.

In a preferred embodiment particularly useful for casino play, step 16 includes the payment of a collection amount 236 by each of frontline players P1–P10 and step 20 includes the payment of a collection amount 238 by each of backline players BP1–BP10 to dealer 214 to compensate the casino for the use of the casino's time and facilities and for the casino's profit in operating the game. It should be understood that collection amounts 236 and 238 could consist of individual fees paid by each frontline and backline player dependent upon the amount of time each player has spent at table 214, of a predetermined fee amount for each hand of frontline or of backline play, or of a percentage of the frontline players' pot and backline players' pot, or some combination of the above. These fees could also be in addition to a cover charge for entrance into the casino facility.

Note that in the embodiment described here, the steps following step 12 and preceding step 22 are in the order step 14, step 16, step 18, and step 20. However, steps 14, 16, 18, and 20 are independent of each other and these four steps may be conducted in any order.

In step 22, the dealer begins play of the associated game by sequentially dealing hands to each frontline player P1–P10, beginning with first-seated player 232. In step 24, play of the game proceeds until frontline players P1–P10 have finished play. Depending on the rules of the associated game, step 24 may include wagering of additional amounts by frontline players P1–P10 and/or backline players B1–B10 as part of play; for example, in poker-type card games frontline players may place or match "raise" wagers.

Referring to FIGS. 2 and 3, in step 26, dealer 218 ranks the frontline players P1–P10 in direct relation to the ranking of each frontline players' hand according to the rules of the associated game. In steps 28 and 30, dealer 218 then assigns ranks to the backline players B1–B10. To accomplish this ranking, each backline player is treated as having the same hand as the frontline player on which the backline player bet. Once all the backline players have been "assigned hands" in this fashion, the "assigned hands" are comparatively ranked according to the rules of the associated game. Each backline player then is ranked in relation to the other backline players in direct relation to the comparative ranking of that backline players' assigned hand, with no further regard to the values of the frontline players' hands. The rankings may include ties between frontline players and between backline players having hands of equal value, depending on the rules of the associated game.

Once the ranking of frontline players P1–P10 and backline players B1–B10 is complete, in step 32 the dealer 218 collects the losing hands and places them into a discard pile.

The No Dice Pot method then determines the distribution of the monies in frontline players' pot 228 and backline players' pot 230 to the winning wagerers. In the preferred embodiment, the predetermined formulas for the frontline players' pot distribution and the backline players' pot distribution operate as described as follows. It should be understood that the No Dice Pot method 10 may also be used with different proportions of winnings between the highest and second-highest ranked players in the distribution of either or both pots than described below in the preferred embodiment. A generalized summary of the manner of distribution of both pots follows; the specifics of the distribution methods will then be presented in relation to the flow diagrams of FIGS. 4, 5, 6-1, 6-2 and 7.

To summarize the preferred distribution method generally: in the preferred embodiment, the exact distributions of the frontline and backline players' pots will vary depending on the number of players contributing to each pot. If two or three players have contributed to the pot, the player with the highest ranked hand wins that entire pot; if there is a tie for the highest ranked hand, each tying player receives an equal share of that pot. If four or more players have contributed to the pot, there is no "winner takes all": the dealer determines both a highest rank and a second highest rank among those players. If more than one player has a hand of the highest rank, those players split that pot equally, and the distribution is finished with nothing going to the second-highest ranked player. Otherwise, the player with the hand of the highest rank takes two-thirds of the pot, and the remaining one-third is distributed to the player or players of the second-highest rank. If more than one player has a hand of the second-highest rank, the dealer distributes the last one-third of that pot in equal shares to those players. Otherwise, the player with the hand of the second-highest rank takes the entire last one-third of the pot.

To present the preferred method for the frontline players' pot distribution in detail, in step 34, the dealer directs distribution of the money in the frontline players' pot according to a predetermined frontline formula. Step 34 is then broken down into substeps 36 through 64 as shown in FIGS. 4 and 5.

In substep 36, the dealer determines whether there was a tie for the highest rank among the frontline players. If so, the dealer proceeds to substep 38. In substep 38, dealer 218 divides the frontline players' pot 220 into a number of equal portions equal to the number of frontline players having the highest rank, leaving any odd chips which cannot be divided equally into the equal portions aside. In substep 40, the dealer determines whether there were any such odd chips. If so, in substep 42, the dealer distributes one odd chip to each frontline player tying for the highest rank, starting with the first such player who follows the first-seated frontline player in the sequential frontline order and continuing through the sequential frontline order, until there are no more odd chips to distribute. Then, in substep 44, the dealer distributes one of the equal portions of the frontline players' pot to each frontline player having the highest rank. At that point, the preferred embodiment of step 34 is complete.

If, at substep 40, no odd chips exist, then the predetermined frontline formula proceeds directly to substep 44.

If, at substep 36, there was only one frontline player having the highest rank, the predetermined frontline formula proceeds to substep 46. As the exact distributions paid to each player differ in the preferred embodiment depending on whether there are more than three frontline players involved in the game, in substep 46 the dealer determines whether there are more than three frontline players. If there are only two or three frontline players, substep 48 is applied, and dealer 218 distributes all the money in the frontline players' pot 228 to the highest-ranked frontline player. At that point, the preferred embodiment of step 34 is complete.

If, at substep 46, the dealer determines that there are more than three frontline players, in substep 50 the frontline players' pot 228 is divided into three equal portions. Two of these portions are distributed to the highest-ranked frontline player, and one is reserved as a remainder for distribution to the one or more frontline players having the second highest rank in substep 52. For a division into three parts, there can be only one or two odd chips; if there are any odd chips, one is distributed to the highest-ranked frontline player, and one is reserved for the remainder of the frontline players' pot.

Substep 52 is pictured in further substeps in FIG. 5. The first substep of substep 52 is substep 54, which determines whether there are a plurality of frontline players having the second highest rank. If not, in substep 56 dealer 218 distributes the remainder of the frontline players' pot to the second-highest ranked frontline player. At that point, the preferred embodiment of step 34 is complete.

If there are a plurality of frontline players having the second highest rank, in substep 58 the dealer divides the remainder of the frontline players' pot into a number of equal portions equal to the number of frontline players tying for the second highest rank, leaving any odd chips which cannot be divided equally into the equal portions aside. In substep 60, dealer 218 determines whether there were any such odd chips. If so, in substep 62, the dealer distributes one odd chip to each frontline player tying for the second highest rank, starting with the first such player who follows the first-seated frontline player in the sequential frontline order and continuing through the sequential frontline order, until there are no more odd chips to distribute. Then, in substep 64, the dealer distributes one of the equal portions of the frontline players' pot to each frontline player having the second-highest rank. At that point, the preferred embodiment of step 34 is complete.

If, at substep 60, no odd chips exist, then the predetermined formula proceeds directly to substep 64.

At this point, all of the funds in the frontline players' pot 228 will have been distributed. Proceeding on to step 66, the dealer distributes the backline players' pot 230 among backline players B1–B10 according to the individual rankings of the backline players. The distribution of the backline players' pot is done in virtually the same manner as for the frontline players' pot, with the only additional information needed being how to determine the sequential backline order in which odd chips are distributed to tying players.

A preferred method of creating a sequential backline order is to include in step 14 the placement of a backline players' marker 240 in front of one of playing areas BP1–BP10. In a preferred embodiment, backline players' marker 240 is positioned to BP1 for the first round, and in subsequent rounds is moved forward by one playing area as a new placement, with BP1 following BP10 to create a circular sequential backline order. Other means of moving the backline players marker 240 can also be employed.

To present the preferred method for the backline players' pot distribution in detail, in step 66, the dealer directs distribution of the money in the backline players' pot according to a predetermined formula. Step 66 is then broken down into substeps 68 through 96 as shown in FIGS. 6-1, 6-2 and 7.

In substep 68, the dealer determines whether there was a tie for the highest rank among the backline players. If so, the dealer proceeds to substep 70. In substep 70, dealer 218 divides the backline players' pot 220 into a number of equal portions equal to the number of backline players having the highest rank, leaving any odd chips which cannot be divided equally into the equal portions aside. In substep 72, the dealer determines whether there were any such odd chips. If so, in substep 74, the dealer distributes one odd chip to each backline player tying for the highest rank, starting with the first such player who follows the first-seated backline player in the sequential backline order and continuing through the sequential backline order, until there are no more odd chips to distribute. Then, in substep 76, the dealer distributes one of the equal portions of the backline players' pot to each highest-ranked backline player. At that point, the preferred embodiment of step 66 is complete.

If, at substep 72, no odd chips exist, then the predetermined backline formula proceeds directly to substep 76.

If, at substep 68, there was only one backline player having the highest rank, the predetermined backline formula proceeds to substep 78. As the exact distributions paid to each player differ in the preferred embodiment depending on whether there are more than three backline players involved in the game, in substep 78 the dealer determines whether there are more than three backline players. If there are only two or three backline players, substep 80 is applied, and dealer 218 distributes all the money in the backline players' pot 228 to the highest-ranked backline player. At that point, the preferred embodiment of step 66 is complete.

If, at substep 78, the dealer determines that there are more than three backline players, in substep 82 the backline players' pot 228 is divided into three equal portions. Two of these portions are distributed to the highest-ranked backline player, and one is reserved as a remainder for distribution to the one or more backline players having the second highest rank in substep 84. For a division into three parts, there can be only one or two odd chips; if there are any odd chips, one is distributed to the player of the highest rank, and one is reserved for the remainder.

Substep 84 is pictured in further substeps in FIG. 7. The first substep of substep 84 is substep 86, which determines whether there are a plurality of backline players having the second highest rank. If not, in substep 88 dealer 218 distributes the remainder of the backline players' pot to the second-highest ranked backline player. At that point, the preferred embodiment of step 66 is complete.

If there are a plurality of backline players having the second highest rank, in substep 90 the dealer divides the remainder of the backline players' pot into a number of equal portions equal to the number of backline players tying for the second highest rank, leaving any odd chips which cannot be divided equally into the equal portions aside. In substep 92, dealer 218 determines whether there were any such odd chips. If so, in substep 94, the dealer distributes one odd chip to each backline player tying for the second highest rank, starting with the first such player who follows the first-seated backline player in the sequential backline order and continuing through the sequential backline order until there are no more odd chips to distribute. Then, in substep 96, the dealer distributes one of the equal portions of the backline players' pot to each backline player having the second-highest rank. At that point, the preferred embodiment of step 66 is complete.

If, at substep 92, no odd chips exist, then the predetermined formula proceeds directly to substep 96.

Referring to FIG. 2, once step 66 is finished, the round is finished, as indicated by step 98. All the chips in both the frontline players' pot 228 and the backline players' pot 230 have been distributed, and a new round of play may commence with step 12.

Note that in the preferred embodiment described here, the steps 26, 28, 30, 32, 34, and 66 proceed in that order. However, these steps can be mixed in any order in which step 26 precedes step 34 and in which step 28 precedes step 66.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. A method of bet placement and wager distribution for use in conjunction with a card game having a plurality of frontline players, a plurality of backline players, a round of play, and associated rules, where said frontline players each control a discrete hand which, at the end of said round of play, may be ranked in comparison with other of said frontline players' hand, comprising the steps of:

identifying said frontline players and said backline players for said round of play;

placing by each of said frontline players a frontline wager amount into a frontline players' pot, summing to a frontline wager sum;

placing by each of said backline players a backline wager amount into a backline players' pot, summing to a backline wager sum;

identifying by each of said backline players one of said frontline players on whom said backline player is wagering;

distributing one of said discrete hands to each of said frontline players;

playing said round of said game, said frontline players each controlling their respective said hand in conformity with said associated rules of said game, each of said hands having a comparative final ranking with respect to the other hands;

determining a frontline comparative final ranking for each of said frontline players in relation to said other frontline players according to said comparative final rankings of said frontline players' hands, said frontline comparative final ranking identifying a highest frontline rank player or players and a second-highest frontline rank player or players;

assigning to each backline player the frontline comparative final ranking of the frontline player on whom said backline player wagered;

determining a backline comparative final ranking for each of said backline players in relation to said other backline players according to said frontline comparative final rankings assigned to each of said backline players, said backline comparative final ranking identifying a highest backline rank player or players and a second-highest backline rank player or players;

distributing said frontline wager sum between said highest frontline rank player or players and said second-highest frontline rank player or players according to a first predetermined formula; and distributing said backline wager sum between said highest backline rank player or players and said second-highest backline rank player or players according to a second predetermined formula.

2. The method of claim 1 wherein said game constitutes a card game and said hands of said frontline players constitute hands of cards dealt to said frontline players.

3. The method of claim 2 wherein said card game may be selected from a variety of card games including Pan Nine, Pai Gow Poker, California Blackjack, Blackjack Jokers, and Royal Double Hand Poker.

4. The method of claim 1 wherein each said frontline wager amount equals a predetermined table limit.

5. The method of claim 1 wherein each said backline wager amount equals a predetermined table limit.

6. The method according to claim 1, wherein a dealer controls play of said game, distributes said hands, and controls collection of wagers and distribution of said players' pots, wherein said step of placing by each of said frontline players a frontline wager further comprises paying by each of said frontline players a predetermined collection amount to said dealer, and wherein said step of placing by each of said backline players a backline wager further comprises paying by said backline players a predetermined collection amount to said dealer.

7. The method of claim 1 wherein said step of identifying by each of said backline players one of said frontline players on whom said backline player is wagering further comprises placing by each of said backline players said backline wager amount into a backline betting area, said backline betting area divided into distinct sub-areas, said sub-areas each corresponding to one of said frontline players, such that one of said backline players may wager on one of said frontline players by placing said wager into the subarea corresponding to that frontline player.

8. The method of claim 7 wherein said subareas of said backline players' pot are configured in a linear sequence, wherein said linear sequence defines a first position subarea and a last position subarea, and wherein said step of identifying said backline players for said round of play is followed by the further steps of:

identifying a first-seated backline player and a sequential backline order among said backline players;

placing a first-seat backline marker adjacent to the subarea of said backline players' pot into which said first-seated backline player placed a wager; and determining said sequential backline order by proceeding from said first-seated backline player through all of said backline players by moving in sequence from one backline player who placed a wager into a first said subarea, to the backline player who placed a wager into a second said subarea, such that said second subarea follows said first subarea in said linear sequence of said subareas, except where said first subarea is said last position subarea in said physical linear sequence, in which case said second subarea is said first position subarea in said physical linear sequence.

9. The method of claim 8 wherein said step of selecting said first-seated backline player further comprises:

selecting, when a prior round of said game has been played and a prior first-seated backline player was selected in said prior round, the backline player following said prior first-seated backline player in said sequential backline order to be said first-seated backline player;

selecting, when no prior first-seated backline player has been selected, the one of said backline players who placed a wager into said first position subarea in said linear sequence to be said first-seated backline player.

10. The method of claim 8 wherein step of distributing said backline wager sum between said backline players further comprises:

dividing, when there is more than one highest backline rank player, the backline wager sum into one equal portion for each highest backline rank player and distributing one such portion to each highest backline rank player, such that if the division creates one or more odd chips which cannot be divided equally into said equal portions, said odd chips are distributed one to each highest backline rank player starting with the highest backline rank player to follow said first-seated backline player in said sequential backline order and continuing to succeeding highest backline rank players according to said sequential backline order until all of said odd chips have been distributed;

distributing, when there is only one highest backline rank player and there are less than four backline players, said backline wager sum to said highest backline rank player;

dividing, when there is only one highest backline rank player and there are four or more backline players, said backline wager sum into three parts, distributing two of said parts to said highest backline rank player, and retaining one of said parts as a remainder to be distributed to said second-highest backline rank player or players, such that if the division creates one or more odd chips which cannot be divided equally into said three parts, one odd chip is distributed to said highest ranked backline player and any other odd chip is added to said remainder;

dividing, when said remainder is retained and there is more than one second-highest rank player, said remainder into one equal portion for each second-highest backline rank player and distributing one such portion to each second-highest backline rank player, such that if the division creates one or more odd chips which cannot be divided equally into said equal portions, said odd chips are distributed one to each second-highest backline rank player starting with the first second-highest backline rank player to follow said first-seated backline player in said sequential backline order and continuing to succeeding second-highest backline rank players according to said sequential backline order until all of said odd chips have been distributed;

distributing, when said remainder is retained and there is only one second-highest backline rank player, said remainder to said second-highest backline rank player.

11. The method of claim 1 wherein said step of identifying said frontline players for said round of play is followed by the further steps of:

identifying a first-seated frontline player starting a sequential frontline order among said frontline players; and placing a first-seat frontline marker adjacent to said first-seated frontline player.

12. The method of claim 11 wherein said frontline players are seated in a circular configuration and wherein said sequential frontline order is determined by proceeding clockwise around said circular configuration of said frontline players from said first-seated frontline player.

13. The method of claim 11 wherein said frontline players are seated in a circular configuration and wherein said sequential frontline order is determined by proceeding counterclockwise around said circular configuration of said frontline players from said first-seated frontline player.

14. The method of claim 11 wherein said step of selecting said first-seated frontline player further comprises:

selecting, when a prior round of said game has been played and a prior first-seated frontline player was selected in said prior round, the frontline player following said prior first-seated frontline player in said sequential frontline order to be said first-seated frontline player;

selecting at random, when no prior first-seated frontline player has been selected, one of said frontline players to be said first-seated frontline player.

15. The method of claim 11 wherein said step of distributing one of said discrete hands to each of said frontline players further comprises beginning with said first-seated frontline player and continuing in a predetermined sequential frontline order among said frontline players.

16. The method of claim 11 wherein said step of distributing said frontline wager sum between the frontline players further comprises:

dividing, when there is more than one highest frontline rank player, the frontline wager sum into one equal portion for each highest frontline rank player and distributing one such portion to each highest frontline rank player, such that if the division creates one or more odd chips which cannot be divided equally into said equal portions, said odd chips are distributed one to each highest frontline rank player starting with the first highest frontline rank player to follow said first-seated frontline player in said sequential frontline order and continuing to succeeding highest frontline rank players according to said sequential frontline order until all of said odd chips have been distributed;

distributing, when there is only one highest frontline rank player and there are less than four frontline players, said frontline wager sum to said highest frontline rank player;

dividing, when there is only one highest frontline rank player and there are four or more frontline players, said frontline wager sum into three parts, distributing two of said parts to said highest frontline rank player, and retaining one of said parts as a remainder to be distributed to said second-highest frontline rank player or players, such that if the division creates one or more odd chips which cannot be divided equally into said three parts, one odd chip is distributed to said highest ranked frontline player and any other odd chip is added to said remainder;

dividing, when said remainder is retained and there is more than one second-highest rank player, said remainder into one equal portion for each second-highest frontline rank player and distributing one such portion to each second-highest frontline rank player, such that if the division creates one or more odd chips which cannot be divided equally into said equal portions, said odd chips are distributed one to each second-highest frontline rank player starting with the first second-highest frontline rank player to follow said first-seated frontline player in said sequential frontline order and continuing to succeeding second-highest frontline rank players according to said sequential frontline order until all of said odd chips have been distributed; and distributing, when said remainder is retained and there is only one second-highest frontline rank player, said remainder to said second-highest frontline rank player.

17. A method of bet placement and wager distribution for use in conjunction with a card game having a plurality of frontline players, a round of play, and associated rules, where said frontline players each control a discrete hand which, at the end of said round of play, may be ranked in comparison with other of said frontline players' hands, comprising the steps of:

identifying said frontline players for said round of play;

placing by each of said frontline players a frontline wager amount into a frontline players' pot, summing to a frontline wager sum;

distributing one of said discrete hands to each of said frontline players;

playing said round of said game, said frontline players each controlling their respective said hands in conformity with said associated rules, each of said hands having a comparative final ranking with respect to the other hands;

determining a frontline comparative final ranking for each of said frontline players in relation to said other frontline players according to said comparative final rankings of said frontline players' hands, said frontline comparative final ranking identifying a highest frontline rank player or players and a second-highest frontline rank player or players;

dividing, when there is more than one highest frontline rank player, the frontline wager sum into one equal portion for each highest frontline rank player and distributing one such portion to each highest frontline rank player, such that if the division creates one or more odd chips which cannot be divided equally into said equal portions, said odd chips are distributed one to each highest frontline rank player starting with the first highest frontline rank player to follow said first-seated frontline player in said sequential frontline order and continuing to succeeding highest frontline rank players according to said sequential frontline order until all of said odd chips have been distributed;

distributing, when there is only one highest frontline rank player and there are less than four frontline players, said frontline wager sum to said highest frontline rank player;

dividing, when there is only one highest frontline rank player and there are four or more frontline players, said frontline wager sum into three parts distributing two of said parts to said highest frontline rank player, and retaining one of said parts as a remainder to be distributed to said second-highest frontline rank player or players, such that if the division creates one or more odd chips which cannot be divided equally into said three parts, one odd chip is distributed to said highest ranked frontline player and any other odd chip is added to said remainder;

dividing, when said remainder is retained and there is more than one second-highest rank player, said remainder into one equal portion for each second-highest frontline rank player and distributing one such portion to each second-highest frontline rank player, such that if the division creates one or more odd chips which cannot be divided equally into said equal portions, said odd chips are distributed one to each second-highest frontline rank player starting with the first second-highest frontline rank player to follow said first-seated frontline player in said sequential frontline order and continuing to succeeding second-highest frontline rank players according to said sequential frontline order until all of said odd chips have been distributed;

distributing, when said remainder is retained and there is only one second-highest frontline rank player, distributing said remainder to said second-highest frontline rank player.

18. The method of claim 17 wherein said game constitutes a card game and said hands of said frontline players constitute hands of cards dealt to said frontline players.

19. The method of claim 18 wherein said card game may be selected from a variety of card games including Pan Nine, Pai Gow Poker, California Blackjack, Blackjack Jokers, and Royal Double Hand Poker.

20. The method of claim 17 wherein each said frontline wager amount equals a predetermined table limit.

21. The method according to claim 17 wherein a dealer controls play of said game, distributes said hands, and controls collection of wagers and distribution of said players' pots, and wherein said step of said frontline players placing a frontline wager further comprises said frontline players paying a predetermined collection amount to said dealer.

22. The method of claim 17 wherein said step of identifying said frontline players for said round of play is followed by the further steps of:

identifying a first-seated frontline player who starts a sequential playing order among said frontline players; and placing a first-seat frontline marker adjacent to said first-seated frontline player.

23. The method of claim 22 wherein said frontline players are seated in a circular configuration and wherein said sequential frontline order is determined by proceeding clockwise around said circular configuration of said frontline players from said first-seated frontline player.

24. The method of claim 22 wherein said frontline players are seated in a circular configuration and wherein said sequential frontline order is determined by proceeding counterclockwise around said circular configuration of said frontline players from said first-seated frontline player.

25. The method of claim 22 wherein said step of selecting said first-seated frontline player further comprises:

selecting, when a prior round of said game has been played and a prior first-seated frontline player was selected in said prior round, the frontline player following said prior first-seated frontline player in said sequential frontline order to be said first-seated frontline player;

selecting at random, if no prior first-seated frontline player has been selected, one of said frontline players to be said first-seated frontline player.

26. The method of claim 22 wherein said step of distributing one of said discrete hands to each of said frontline players further comprises beginning with said first-seated frontline player and continuing in said predetermined sequential frontline order among said frontline players, distributing one of said discrete hands to each of said frontline players.

27. A method of bet placement and wager distribution for use in conjunction with a card game having a dealer, a plurality of frontline players, a plurality of backline players, a round of play, and associated rules, where said frontline players each control a discrete hand which, at the end of said round of play, may be ranked in comparison with other of said frontline players' hands, comprising the steps of:

identifying said frontline players and said backline players for said round of play;

placing by each of said frontline players an equal frontline wager amount into a frontline players' pot, summing to a frontline wager sum;

placing by each of said backline players an equal backline wager amount into a backline players' pot, summing to a backline wager sum;

identifying by each of said backline players one of said frontline players on whom said backline player is wagering;

distributing by said dealer one of said discrete hands to each of said frontline players;

playing said round of said game, said frontline players each controlling their respective said hand in conformity with said associated rules of said game, each of said hands having a comparative final ranking with respect to the other hands;

determining a frontline comparative final ranking for each of said frontline players in relation to said other frontline players according to said comparative final rankings of said frontline players' hands, said frontline comparative final ranking identifying a highest frontline rank player or players and a second-highest frontline rank player or players;

assigning to each backline player the frontline comparative final ranking of the frontline player on whom said backline player wagered;

determining a backline comparative final ranking for each of said backline players in relation to said other backline players according to said frontline comparative final rankings assigned to each of said backline players, said backline comparative final ranking identifying a highest backline rank player or players and a second-highest backline rank player or players;

distributing said frontline players' pot according to a predetermined frontline formula, said predetermined frontline formula comprising the steps:

dividing, when there is more than one highest frontline rank player, the frontline wager sum into one equal portion for each highest frontline rank player and distributing one such portion to each highest frontline rank player, such that if the division creates one or more odd chips which cannot be divided equally into said equal portions, said odd chips are distributed one to each highest frontline rank player starting with the first highest frontline rank player to follow said first-seated frontline player in said sequential frontline order and continuing to succeeding highest frontline rank players according to said sequential frontline order until all of said odd chips have been distributed;

distributing, when there is only one highest frontline rank player and there are less than four frontline players, said frontline wager sum to said highest frontline rank player;

dividing, when there is only one highest frontline rank player and there are four or more frontline players, said frontline wager sum into three parts distributing two of said parts to said highest frontline rank player, and retaining one of said parts as a remainder to be distributed to said second-highest frontline rank player or players, such that if the division creates one or more odd chips which cannot be divided equally into said three parts, one odd chip is distributed to said highest ranked frontline player and any other odd chip is added to said remainder;

dividing, when said remainder is retained and there is more than one second-highest rank player, said remainder into one equal portion for each second-highest frontline rank player and distributing one such portion to each second-highest frontline rank player, such that if the division creates one or more odd chips which cannot be divided equally into said equal portions, said odd chips are distributed one to each second-highest frontline rank player starting with the first second-highest frontline rank player to follow said first-seated frontline player in said sequential frontline order and continuing to succeeding second-highest frontline rank players according to said sequential frontline order until all of said odd chips have been distributed; and distributing, when said remainder is retained and there is only one second-highest frontline rank player, said remainder to said second-highest frontline rank player; and distributing said backline players' pot according to a predetermined backline formula, said predetermined backline formula comprising the steps:

dividing, when there is more than one highest backline rank player, the backline wager sum into one equal portion for each highest backline rank player and distributing one such portion to each highest backline rank player, such that if the division creates one or more odd chips which cannot be divided equally into said equal portions, said odd chips are distributed one to each highest backline rank player starting with the highest backline rank player to follow said first-seated backline player in said sequential backline order and continuing to succeeding highest backline rank players according to said sequential backline order until all of said odd chips have been distributed;

distributing, when there is only one highest backline rank player and there are less than four backline players, said backline wager sum to said highest backline rank player;

dividing, when there is only one highest backline rank player and there are four or more backline players, said backline wager sum into three parts, distributing two of said parts to said highest backline rank player, and retaining one of said parts as a remainder to be distributed to said second-highest backline rank player or players, such that if the division creates one or more odd chips which cannot be divided equally into said three parts, one odd chip is distributed to said highest ranked backline player and any other odd chip is added to said remainder;

dividing, when said remainder is retained and there is more than one second-highest rank player, said remainder into one equal portion for each second-highest backline rank player and distributing one such portion to each second-highest backline rank player, such that if the division creates one or more odd chips which cannot be divided equally into said equal portions, said odd chips are distributed one to each second-highest backline rank player starting with the first second-highest backline rank player to follow said first-seated backline player in said sequential backline order and continuing to succeeding second-highest backline rank players according to said sequential backline order until all of said odd chips have been distributed;

distributing, when said remainder is retained and there is only one second-highest backline rank player, said remainder to said second-highest backline rank player.

* * * * *

UNITED STATES PATENT AND TRADEMARK OFFICE

CERTIFICATE OF CORRECTION

PATENT NO. : 5,871,213
DATED : February 16, 1999
INVENTOR(S) : Paul G. Chadband; Hai Q. Huynh; and James R. McKee It is certified that error appears in the above-identified patent and that said Letters Patent is hereby corrected as shown below:

James R. McKee is an inventor in the above-identified Patent. Accordingly, the inventors are:

Paul G. Chadband;
Hai Q. Huynh; and
James R. McKee, all of San Jose, Calif.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*